United States Patent [19]

Brunner et al.

[11] Patent Number: 4,667,863

[45] Date of Patent: May 26, 1987

[54] TRANSPORT ROLLER ARRANGEMENT FOR TAPE OR SHEET MATERIAL OF VARIOUS WIDTHS

[75] Inventors: Rudolf Brunner; Gerhard Oberhoffner, both of Munich, Fed. Rep. of Germany

[73] Assignee: AGFA-Gevert AG, Leverkusen, Fed. Rep. of Germany

[21] Appl. No.: 678,008

[22] Filed: Nov. 30, 1984

[30] Foreign Application Priority Data

Dec. 23, 1983 [DE] Fed. Rep. of Germany ..... 3346587

[51] Int. Cl.[4] ..... B65H 20/02

[52] U.S. Cl. ..... 226/1; 226/184; 226/189; 226/190

[58] Field of Search ..... 226/181, 184, 189, 190, 226/17, 1, 4; 242/76

[56] References Cited

U.S. PATENT DOCUMENTS

| | | | |
|---|---|---|---|
| 2,793,033 | 5/1957 | Seelen | 226/184 X |
| 2,822,169 | 2/1958 | Lorig | 226/189 |
| 3,294,330 | 12/1966 | Whitely | 226/184 X |
| 3,465,936 | 9/1969 | Wright | 226/184 X |
| 4,326,791 | 4/1982 | Beer et al. | 226/184 X |

FOREIGN PATENT DOCUMENTS

| | | | |
|---|---|---|---|
| 152233 | 7/1963 | U.S.S.R. | 226/181 |

*Primary Examiner*—John M. Jillions
*Attorney, Agent, or Firm*—Michael J. Striker

[57] ABSTRACT

A pair of transport rollers for transporting therebetween a tape or sheet material, such as film, for example in a wet processing device, in which one roller is cylindrical and another roller includes two outwardly converging conical end portions and a cylindrical intermediate portion, whereby two or more films can be transported by the roller pair simultaneously.

11 Claims, 4 Drawing Figures

TRANSPORT ROLLER ARRANGEMENT FOR TAPE OR SHEET MATERIAL OF VARIOUS WIDTHS

BACKGROUND OF THE INVENTION

The present invention relates to a transport roller arrangement in which a pair of rotating rollers are provided to transport a tape or sheet material therebetween, preferably for a wet processing device for processing photographic films.

Transport roller arrangements in which two rollers are placed in contact with each other and supported at their shafts at two opposite bearing plates, are known.

The transport roller arrangements of this type having two cylindrical rollers of the same or different diameters are employed in almost all devices in which sheets or tapes are to be transported. Usually rollers made of rubber or synthetic plastic material of suitable composition are utilized for this purpose so that the outer guiding surface of each roller has a required roughness which must be most suitable for the material being transported and the medium through which the material is transported. All these roller pairs or arrangements have in common that tapes or sheets of various widths, which are smaller than the length of each roller in the pair can be guided by the rollers. However, it has not been possible to transport and therefore process two films the width of which is smaller than the half of the roller, simultaneously without the additional guiding means because these films tend to shift in the direction transversal to the direction of tranportation and thus to overlap each other during the running between the rollers.

SUMMARY OF THE INVENTION

It is an object of the present invention to provide an improved arrangement of transport rollers for transporting sheet or tape material.

It is another object of the present invention to provide a roller pair arrangement which would enable not only the transportation of the tape or sheet material of various widths but also of two or more sheets or tapes simultaneously without damaging the sheets or tapes being transported.

These and other objects of this invention are attained by a transport roller arrangement for transporting tape or sheet material of various widths in a tape or sheet processing device, preferably in a wet processing device for photographic films, comprising a pair of rotary rollers positioned opposite one another to transport the material therebetween and each having end shafts; and two bearing plates positioned opposite to each other to receive and support the end shafts of each roller, at least one of said rollers being a double-conical stepped roller and including two conical end portions and a cylindrical intermediate portion extended between said end portion.

The end portions may converge towards the respective end shafts of said one roller.

Said another roller may be cylindrical over its entire length, and the diameter of said cylindrical portion of said one roller may be equal to the diameter of said another roller.

The length of each of said rollers may be at least equal to the maximal width of the material to be transported, and the length of each of said end portions of said one roller may be greater than the maximal sheet or tape material if two sheets or tapes are to be transported.

An angle included between an imaginary peripheral line of each end conical portion and an imaginary peripheral line of said cylindrical intermediate portion may be between 7′ and 8′.

The device may further include means forming guiding surfaces extended perpendicular to the end shafts of the rollers for laterally positioning and guiding the material being transported between the rollers.

The guiding surfaces may be provided on said bearing plates.

Both rollers of the pair may be identical double conical stepped rollers. In this case, an angle included between an imaginary peripheral line of each conical portion of each roller and an imaginary peripheral line of the intermediate cylindrical portion of each roller is between 3′ and 4′.

The length of the cylindrical portion of said one roller may be greater than the smallest width of the material to be transported, whereby three tapes or sheets can be transported simultaneously, and wherein additional guiding surface means may be provided for supporting an intermediate one of the three tapes or sheets being transported.

The device may further include brackets clamped on said bearing plates, said brackets forming said guiding surface means.

The arrangement may be employed in a wet processing device in a transport unit for transporting a sheet material along a substantially U-shaped track; the unit comprises a plurality of pairs of transport rollers arranged in spaced relationship along said track so that the material is transported between the rollers of each pair from one pair to a next pair, each roller of each pair, which is positioned in said unit outwardly of said track being a double-conical stepped roller including two conical end portions and an intermediate cylindrical portion, and each roller of each pair, which is positioned in said unit inwardly of said track being a completely cylindrical roller.

The arrangement of the pair of rollers according to the invention ensures that two adjacent tapes or sheets, preferably films of the width smaller than the half of each roller can be easily transported without overlapping each other during the running because the displacement of the films towards the middle of the rollers encounters at the conical portions an increased resistance which forces the tapes or sheets in the direction outwardly towards the bearing plates. This effect is as surprising as the effect of the known cambered deflecting rollers because the material being transported is oriented symmetrically to the middle transverse plane of the cambered rollers. The double-conical rollers act on the material in the same manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
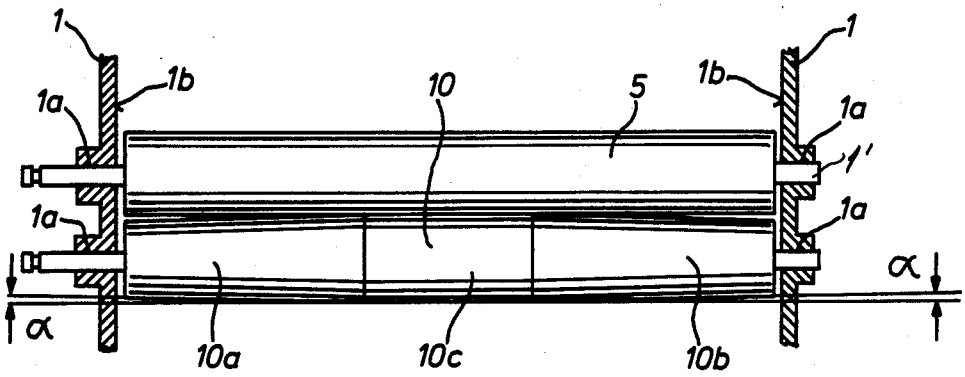
FIG. 1 is a partial sectional view of the transport roller pair in the transporting device according to the invention.
Figure 2:
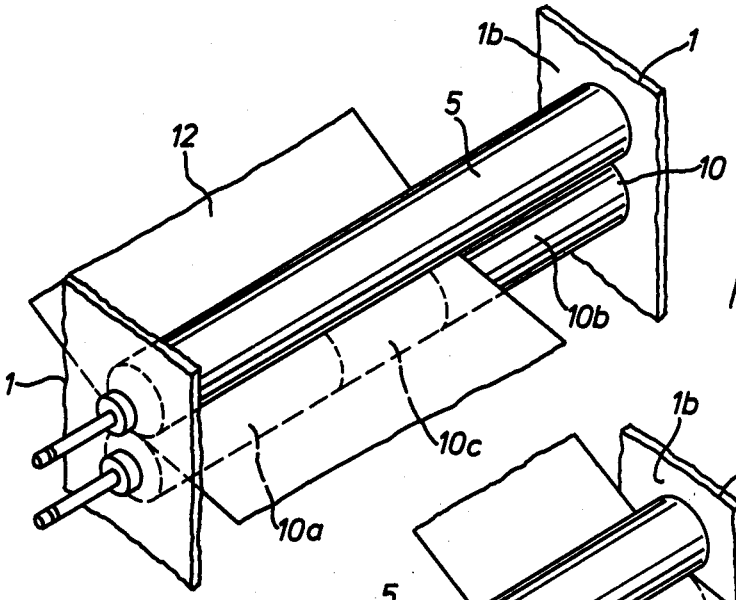
FIG. 2 is a perspective view of the transport roller pair, illustrating a mode of transporting a wide sheet material.
Figure 3:
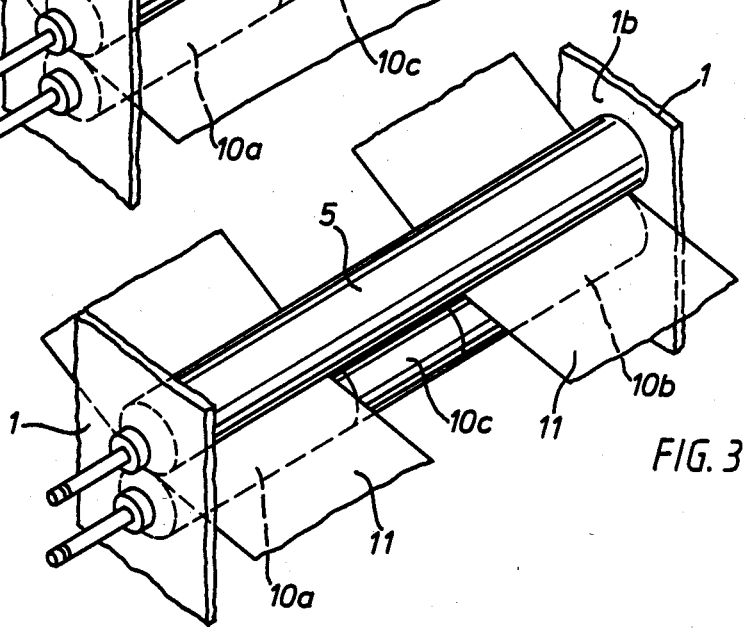
FIG. 3 is a perspective view of the transport roller pair illustrating a mode of transporting of two narrower sheets of material.

Referring now to the drawings in detail and firstly to FIGS. 1–3 thereof, it is seen that a pair of transport rollers for guiding and transporting a tape or sheet material therethrough includes two rollers 5 and 10, the shaft 1' of which are supported in respective bores 1*a* provided in two opposite bearing plates 1. Only portions of the bearing plates 1 are shown in the drawings. It is to be understood that the construction and the shape of bearing plates 1 and their position in the film processing apparatus may be selected in any suitable manner. Rollers 5 and 10 are rotated in the conventional manner by any conventional drive which is not shown herein for the sake of simplicity.

Planar surfaces 1*b* of the bearing plates, facing the transport rollers also serve as supporting or guiding surfaces for the material being transported. Special guiding surfaces can be additionally provided in the device for this purpose. Rollers 5 and 10 are made out of any suitable material normally utilized for the rollers of this type to provide for required properties of the outer surfaces of the rollers.

If rollers 5, 10 shown in FIG. 1 are utilized in a film processing machine for transporting individual film sheets of format 10×10 cm or film rollers of 105 mm, 100 mm, 90 mm, 70 mm, and 35 mm -wide these rollers as shown in FIG. 1 are on the natural scale.

As mentioned above in a pair of conventional transport rollers of the foregoing type both rollers have the same diameter; this allows the transportation of only one film sheet or film tape and also when the film width is substantially smaller than the half of the roller length because in the event of the utilization of two cylindrical rollers if two adjacent films are transported simultaneously through these rollers they can run obliquely and can even partially overlap each other during the transportation.

In order to permit the simultaneous transportation by two rollers 5, 10 of two films 11, for example 35 mm-film rolls, and thereby the simultaneous development of these two film rolls in the developing apparatus, one of the transport rollers, which is roller 10,is formed according to this invention of three roller portions. Roller 10 is formed at its ends as a tapering double-conical roller or double-conical stepped roller with two conical portions 10*a*, 10*b* converging outwardly and with an intermediate cylindrical portion 10*c*. The cylindrical portion 10*c* is the portion having the greatest diameter of the roller 10. It has been established that the diameter of this portion 10*c* in this embodiment is equal to the diameter of the fully cylindrical roller 5. When it is necessary in a special case, however the diameter of cylindrical roller portion 10*c* can be greater or smaller than the diameter of cylindrical roller 5. The length of each conical portion 10*a*, 10*b* must be greater than the greatest width of each film 11 being processed, since then the effect of aligning of each film 11 relative to the respective bearing plate surface 1*b* is substantially increased because the inner edges of the films will not be squeezed in the small gap between the cylindrical roller 5 and the cylindrical portion 10*c* of the stepped roller 10. Furthermore, the enlargement of the gap in the directions towards the bearing plates 1 is avoided. However, if the width of each film is so large that a small portion of its inner edge would extend beyond the edge of the cylindrical portion 10*c*, the tendency of film 11 to travel or remain in the enlarged wedge-shaped gap between rollers 5 and 10, and also due to a small resistance of the films, will be still sufficient to avoid the substantial displacement of two films 11 towards each other and their overlapping during the transportation.

FIG. 2 illustrates the process of transporting of relatively wide films 12; only one such film at a time can be transported by rollers 5, 10. The lateral edge of film 12 is supported against the inner guiding surface 1*b* of one bearing plate 1 or any other suitable guiding surface. A surprising and unknown with cambered rollers effect of aligning of the material being driven symmetrically to the transversal middle plane of the rollers occurs. This can be explained by the fact that the smallest resistance against the lateral displacement takes place to the side at which the longest wedge-shaped gap portion between rollers 5 and 10 in the region of the film is positioned (the left-hand side gap portion in FIG. 2). In the case of film 12 which does extend over the entire length of the rollers this will be always the side at which the film is supported on the bearing plate 1.

Each conical portion has an advantageous angular region defined by angle $\alpha$ included between the peripheral line of cylindrical portion 10*c* and the adjacent peripheral line of each of the conical stepped portions 10*a*, 10*b*, this angle being in the range between 7' and 8'. The angular region on each roller portion is illustrated in FIG. 1 by thicker lines. In the rollers for transporting wide films the optimal angle range for angle $\alpha$ can be different.

When rollers 5 and 10 serve for a straight-line planar transportation of films two double conical rollers in one roller pair are used whereby the obliquity of the peripheral line of the conical roller portions relative to its cylindrical portion is defined only by $\alpha/2$ which is 3' or 4' so that the wedgeshaped gap between both rollers is not large. If rollers 5 and 10 serve, however for deflecting the films 1 in their transportation path each roller 5 then, which faces towards the concavely curved or curved film, must be formed as a fully cylindrical roller.

It is also posible to transport by means of two rollers 5 and 10 three films of small width simultaneously, for example three 16 mm-films; thus two of these films will be supported and held in position at two opposite bearing plates 1 whereas the third film will be held on the cylindrical portion 10*c* and symmetrically to the transverse middle plane of the rollers. To prevent the intermediate one of three films being guided from running off towards any side additional guiding surfaces can be selectively provided before and after the pair of the transporting rollers; for example yokes or brackets can be clamped to the bearing plates to provide those additional guiding surfaces. Under certain circumstances, for example with long rollers for the simultaneous transportation of two 70 mm-films, it can be expedient to provide that the conical roller of the roller pair be formed of a plurality of counter conical portions with intermediate cylindrical portions of respective diameters. Due to the additional plugging of one or more intermediate guiding surfaces for the film transportation a great number of the films of small width can be simultaneously transported and therefore processed.

Figure 4:
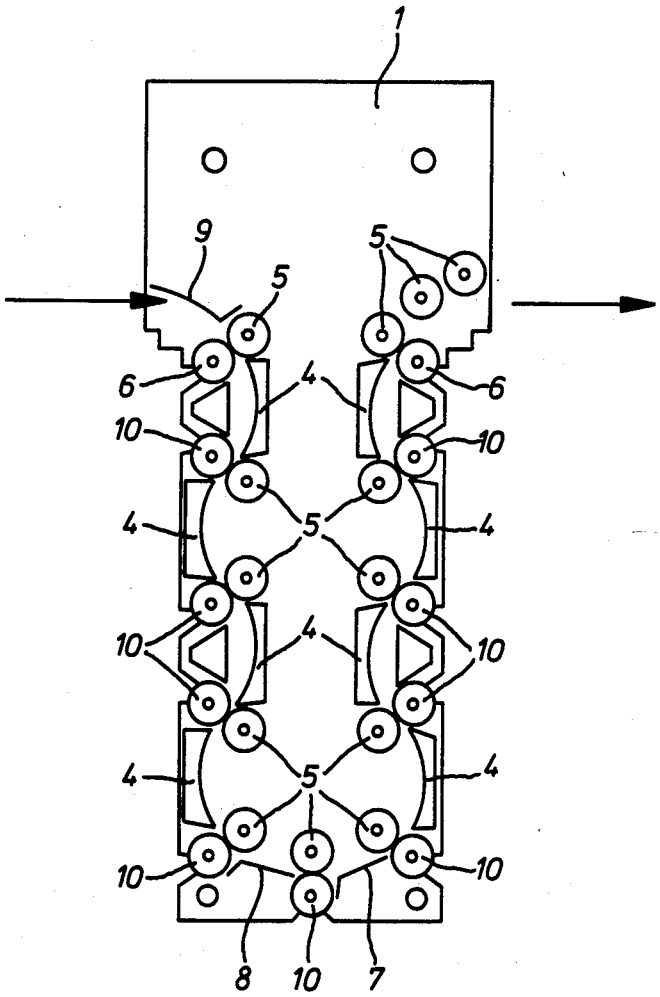
FIG. 4 is a schematic side view of the transporting unit in which the transport rollers of this invention are employed.

FIG. 4 schematically illustrates the arrangement of the roller pairs according to the invention in a wet processing apparatus (developing, fixing and watering tank) for processing films, which is applied to a known transportation unit (rack). The structural components similar to those shown in FIGS. 1 through 3 are designated by the same reference numerals.

In the transport unit of this type the film is normally transported over the U-shaped or loop-shaped track or path. FIG. 4 shows a U-shaped track. An inlet roller pair 5, 6, and an outlet roller pair 5, 6 as well as transport-and-deflecting roller pairs 5, 10 are provided in the unit. Guiding surfaces 4, 7, 8 and 9 are arranged between the respective pairs of rollers to guide the films between the pairs of the transport rollers along the U-shaped track. Rollers 5 of each pair are fully cylindrical rollers. Since the film has a tendency to curve or bend concavely inwardly along the U-shaped track of its transportation cylindrical rollers 5 are respectively positioned inwardly relative to the film in the unit while the double-conical rollers 6 and 10 are positioned outwardly relative to the film along the whole U-shaped track. The double-conical inlet and outlet rollers 6 can be advantageously made of rubber whereas rollers 10 can be made of PVC for better fluid resistance.

The possibility to select one film of a greater width or two films of a smaller width leads in the case of processing of smaller films to the increase in capacity of about 100% without requiring any exchange of the apparatus or an additional apparatus. The roller arrangement according to the invention astonishingly reduces a number of so-called pinholes in the films of all widths.

It will be understood that each of the elements described above, or two or more together, may also find a useful application in other types of transport roller arrangements for transporting sheet material of various widths differing from the types described above.

While the invention has been illustrated and described as embodied in a transport roller pair for transporting films of various widths, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of transporting tapes and sheets of photographic material of various widths in a wet processing device for photographic films, comprising the steps of providing a pair of elongated rotary transport rollers positioned one against the other to receive sheets or tapes of photographic material therebetween and formed so that at least one of said transport rollers being a double-conical stepped roller and includes two conical end portions and a cylindrical intermediate portion extended between said end portions and said rollers are of substantially the same length and wherein the length of the cylindrical portion of said one roller is greater than the smallest width of the tape to be transported; and selectively transporting one sheet or tape of photographic material of a greater width between said rollers, or three tapes or sheets of photographic material of a smaller width simultaneously so that overlapping of said three tapes during the transport is avoided and said cylindrical portion forms additional guiding surface means for supporting an intermediate one of the three tapes being transported.

2. The method as defined in claim 1, wherein said providing step includes providing the rollers having end shafts and formed so that said end portions of said one roller converge towards the end shafts of said one roller.

3. The method as defined in claim 2, wherein said providing step includes providing another roller which is cylindrical over its entire length, and wherein the diameter of said cylidrical portion of said one roller is equal to the diameter of said another roller.

4. The method as defined in claim 1, wherein said providing step includes providing said one roller such that an angle included between an imaginary peripheral line of each end conical portion and an imaginary peripheral line of said cylindrical intermediate portion is between 7' and 8'.

5. The method as defined in claim 1, wherein said providing step includes providing rollers with end shafts; further including the step of laterally positioning and guiding the material being transported between the rollers, by guiding surfaces extended perpendicular to the end shafts of the rollers.

6. The method as defined in claim 5, further including the step of supporting the end shafts by bearing plates on which said guiding surfaces are provided.

7. The method as defined in claim 6, wherein said positioning and guiding step includes using said rollers for deflecting the direction of transportation of said material, the rollers including a cylindrical roller arranged so that it faces a concavely curved side of the material being deflected by said rollers.

8. The method as defined in claim 1, wherein said providing includes providing step both rollers in the pair as identical double conical stepped rollers.

9. The method as defined in claim 8, wherein said providing step includes providing an angle included between an imaginary peripheral line of each conical portion of each roller and an imaginary peripheral line of the intermediate cylindrical portion of each roller is between 3' and 4'.

10. The method as defined in claim 6, further including clamping of brackets on said bearing plates so as to form guiding surface means.

11. In a wet processing device a transport unit for transporting a photographic sheet material comprises a plurality of pairs of transport rollers arranged in spaced relationship so that a substantially U-shaped track is defined between a first pair of transport rollers receiving the photographic sheet material being transported by said unit and a last pair of transport rollers discharging the photographic sheet material from said unit and the photographic sheet material is transported between the rollers of each pair from one pair to a next pair along said track, each pair of said transport rollers having an outer roller facing a pheripery of said transport unit and an inner roller opposing said outer roller, the outer roller of each pair being a double-conical stepped roller including two conical end portions and an intermediate cylindrical portion, and the inner roller of each pair being a completely cylindrical roller.

* * * * *